United States Patent [19]

Watanabe

[11] 4,350,440

[45] Sep. 21, 1982

[54] DEVELOPING APPARATUS

[75] Inventor: Tsuyoshi Watanabe, Kawasaki, Japan

[73] Assignee: Canon Kabushiki Kaisha, Tokyo, Japan

[21] Appl. No.: 167,194

[22] Filed: Jul. 9, 1980

[30] Foreign Application Priority Data

Jul. 16, 1979 [JP] Japan ..... 54/91161

[51] Int. Cl.[3] ..... G03G 15/09

[52] U.S. Cl. ..... 355/3 DD; 355/14 D; 355/15; 118/657; 118/658; 118/639; 430/97; 430/102; 430/122

[58] Field of Search ..... 355/3 DD, 15, 14 D, 355/3 R, 14 R; 118/657, 658, 639; 430/122, 97, 102

[56] References Cited

U.S. PATENT DOCUMENTS

| | | | |
|---|---|---|---|
| 3,457,900 | 7/1969 | Drexler | 118/637 |
| 3,543,720 | 12/1970 | Drexler et al. | 118/637 |
| 3,739,749 | 6/1973 | Kangas et al. | 118/658 |
| 3,999,514 | 12/1976 | Abbott et al. | 118/657 |
| 4,226,524 | 10/1980 | Hashimoto | 118/658 X |
| 4,244,322 | 1/1981 | Nomura et al. | 118/658 |
| 4,265,197 | 5/1981 | Toyono et al. | 118/657 |

*Primary Examiner*—Arthur C. Prescott

*Attorney, Agent, or Firm*—Fitzpatrick, Cella, Harper & Scinto

[57] ABSTRACT

A developing apparatus as used in copying machine etc. having a rotary sleeve and a magnetic field generating means arranged in the inside thereof, forming toner gain layer on the surface of the rotary sleeve, and developing the electrostatic images on the electrostatic image holding body by bringing the sleeve surface near the electrostatic image holding body, in which the electrostatic image areas on said electrostatic image holding body and passed through the neighborhood of the magnetic poles of the generating means of magnetic fields different in polarity which and arranged, adjacent to each other, in said sleeve which faces said electrostatic image holding body to develop said electrostatic images and then to remove the fog by using the magnetic pole reverse in polarity to the developing magnetic pole.

7 Claims, 3 Drawing Figures

DEVELOPING APPARATUS

BACKGROUND OF THE INVENTION

1. Field of the Invention

This invention relates to a developing apparatus in the picture forming devices such as the copying machines, laser beam printers, and the printers to which magnetic latent image is applied or more particularly to a developing apparatus capable of developing (including magnet brush development, jumping developments, etc.) the electrostatic image on the electrostatic image holder (including the light sensitive bodies capable of holding electrostatic images).

2. Description of the Prior Art

Until now, in the developing apparatus of copying machines etc. (including other devices which have developing method and apparatus to form electromagnetic image and develop the image) the system which can be called to indiscriminate developing methods such as the fur brush developing method, cascade developing method, magnet brush developing method and powder cloud developing method in which the toner is made to contact with the whole area (the picture area and no-picture area which should not absorb the toner) on the electrostatic image holding body surface and the toner is left only to the picture area has been known.

In this system, however, the so called generation of fogging phenomenon in which some toner sticks to and remains on the no-picture area on the surface of the electrostatic image holding body cannot be avoided. To prevent this fogging phenomenon from being generated in magnet brush developing method the sticking of the toner is reduced by weakening the magnetic field at the developing section in order to reduce the amount of the toner sticking to the no-picture area. However, when this is done, the sticking of the toner to the picture area is also reduced, resulting in low picture density.

In the toner projection development system, one of the so-called jumping development systems described in U.S. patent application Ser. Nos. 58,434, now abandoned, and 58,435, now U.S. Pat. No. 4,292,387 by this assignee in which the surface of the electrostatic image holding body and the developing roller etc. are arranged face to face and development is made by letting the toner travel back and forth between them, although the fogging is surely reduced compared with the conventional system complete avoidance of the generation of fogging phenomenon was a difficult matter. In the works, although it is considered to strengthen the binding of the toner to the developing roller by intensifying the magnetic field of the developing pole of the developing section to reduce the jumping of the toner to the no-picture area, in this use also the reduction of picture density cannot be avoided since the jumping of the toner to the picture area is reduced with the reduction in the toner jumping to the no-picture and similar to the above-mentioned case.

SUMMARY OF THE INVENTION

Therefore, this invention is intended to offer a new developing apparatus in which the above-mentioned conventional drawbacks are improved.

The main object of this invention is to offer a developing apparatus which is capable of offering pictures of high quality with high picture density and free of fogging phenomenon in the development by picture forming apparatus such as copying machine.

Another subject of this invention is to offer a developing apparatus of very simple construction which is capable of processing both the so-called development and the removal of fog resulting from the development.

This invention which attains these objects is a developing apparatus so composed as to have a developing agent having magnetic body as one of its constituents, a developing agent holding body composed of non-magnetic body which has the developing agent on its surface and which rotates, a mean of supplying the developing agent to the developing agent holding body, a magnetic field generating means provided on the inside of the above-mentioned developing agent holding body, and having a magnetic pole used by the magnetic field generating means to perform development in the developing area, and a magnetic pole having the reverse polarity to the above-mentioned developing magnetic pole which is used to remove fogging by pulling the developing agent stuck to the no-picture area of the latent image holding body back to the developing, agent holding body by using magnetic force. The most general developing agent holding body referred to here is a non-magnetic sleeve, and the typical developer is a one-constituent magnetic toner. Of course it is not limited to one-constituent developing agent as long as it contains magnetic toner. The magnetic field generating apparatus is composed of a magnet roll or individual magnets.

The developing magnetic pole and the pole for removing the fogging and established in parallel to apply magnetic fields different in polarity from each other, to the image holding body such as the light sensitive drum in developing area. To improve the fog removing effect it is recommended to make the intensity of the magnetic field of the magnetic pole for fog removal stronger than that of the developing magnetic pole.

The above-mentioned and other objects and characteristics of this invention will be understood more clearly by reading the following detailed description, referring to the appended drawings.

DESCRIPTION OF PREFERRED EMBODIMENT

Figure 1:
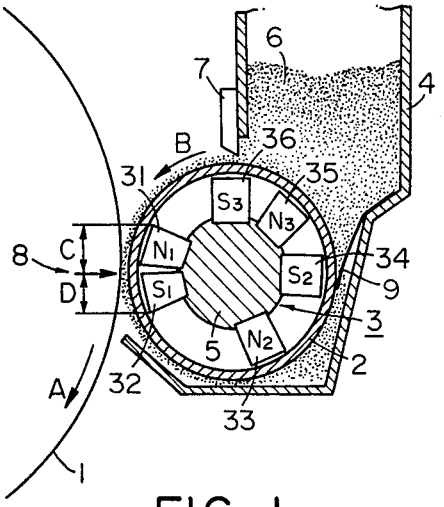
FIG. 1 is the cross sectional view of the invented developing apparatus applied to the jumping development.

This invention will now be described in more detail based on the embodiments. FIG. 1 is the cross sectional view of the invented developing apparatus applied to the above mentioned jumping developing system. In the drawing, 1 is the electrostatic image holding body (referred to as the light sensitive body hereafter) capable of rotating in the direction of the arrow mark A; 2 is the sleeve on whose inside are provided the magnets 31, 32, 33, 34, 35, 36 which form the magnetic field generating means 3.

The sleeve 2 is established rotatably around the outer circumference of the magnetic field generating means 3 in the direction of arrow mark B and near the light sensitive body 1. The magnets 31, 32, 33, 34, 35, 36 on the inside of the sleeve 2 are fixed in the circumferential direction of the roller 5 which is fixed to the developing apparatus box 4 and are arranged as shown in FIG. 1 in the order of the developing magnetic pole N1, fog removing magnetic pole S1, toner carrying magnetic poles, N2, S2, N3 and the cut magnetic pole S3, and both the developing magnetic pole N1 and fog removing magnetic pole S1 are arranged, adjacent to each other, at the position corresponding to the light sensitive drum 1 or the developing area.

The top of the developing apparatus box 4 forms a hopper where the magnetic toner 6 is stored. The magnetic toner 6 is supplied to the sleeve 2 from this hopper. By the rotation of the sleeve 2, in the direction of the arrow mark B the magnetic toner 6 is retained and carried on the outer circumferential surface of the sleeve 2 and a toner grain layer of a predetermined thickness is formed by the blade 7.

Although the blade 7 is allowed to be made of non-magnetic material, if it is formed with magnetic materials such as iron and nickel, and if the cut magnetic pole 36 is established at the opposite position of the magnetic blade, the toner layer on the surface of the sleeve 2 can be made very thin. The operation and effect of this formation is detailed in U.S. patent application Ser. No. 938,494, now abandoned, provided by this assignee.

The thin toner layer that has been formed on the sleeve is transferred toward the section 8 of the sleeve which faces the light sensitive drum 1. In the C area (developing area) where the magnetic pole N1 faces the light sensitive drum 1 an electric field that will be described later is applied across the electrostatic image on the light sensitive drum 1 and the sleeve 2, the toner 6 is held in a thin layer form on the sleeve 2 by magnetic force, and a clearance is formed between the toner layer and the light sensitive drum. However, when the electric field intensity is stronger than the magnetic force, the toner in thin layer form jumps to the surface of the light sensitive drum in succession, and the electrostatic image on the light sensitive drum 1 is visualized. Since the electric field which makes these toner 6 jump to the surface of the light sensitive drum 1 is generated only in the picture area, the toner 6 is not expected to stick to the no-picture area. However, since some toner has electric charge of reversed polarity, actually more or less toner sticks to the no-picture area to cause the so-called fogging to occur.

When the sleeve 2 has passed the above mentioned C area and is in the D area (defogging area) which faces the magnetic pole S1, it is under the influence of the intensity of the magnetic force of the magnetic pole S1.

Leave the intensity of this magnetic field stronger than the intensity of the magnetic field generated by the magnetic pole N1 in C area. Then since the magnetic force generated by this magnetic pole S1 is stronger than the intensity of the magnetic field generated by the electrostatic image on the light sensitive drum 1. Therefore the toner 6 cannot jump to the surface of the light sensitive drum 1 from the sleeve 2. And further, the toner on the light sensitive drum 1 receives a strong magnetic force which acts to make the toner reversely to the direction of the sleeve 2. In this case, however, although the toner on the picture area is not made to jump toward the sleeve 2 again because of the presence of sticking force between the toner and the light sensitive drum 1, the coulomb force by the electrostatic image, and the condensating force among the toner granules, the small quantity of the toner in the no-picture area is made to jump toward the sleeve 2 by the strong magnetic force generated by the magnetic pole S1 since its coulomb force is small compared with that of the picture area and since its sticking force to the light sensitive drum is weaker.

Accordingly by the passing of the electrostatic image area on the light sensitive drum 1, together with the sleeve 2 holding the toner 6, by the facing section 8 of the light sensitive drum 1 almost in synchronization through the areas which are under influence of magnetic fields generated by the magnetic poles N1 and S1 which are different from each other in polarity, the electrostatic image is developed in C area and later the development is finished in the state removed of fogging in D area by the magnetic pole S1, which is different in polarity from the developing magnetic pole N1. In this case, the same result can be obtained even when the reverse polarity between the magnetic poles N1 and S1 is reversed.

Moreover, according to the experiments the intensity of the magnetic field of the magnetic pole N1 is most suitable at about 500 to 700 gauss. Below 500 gauss the toner layer does not come into ears causing incomplete development. Over 700 gauss the magnetic force is too strong and the toner 6 is bound to the sleeve 2 and hard to jump from it, also causing incomplete development.

The most suitable intensity of the magnetic field of the magnetic pole S1 is 600 to 1000 gauss. Defogging effect is weak under 600 gauss and over 1000 gauss is not favorable because even the toner in the picture area is peeled off.

The item having the number 9 in the drawing is the scraper which peels off the toner on the sleeve 2. Next the case of magnet brush development will be described referring to FIG. 2.

Figure 2:
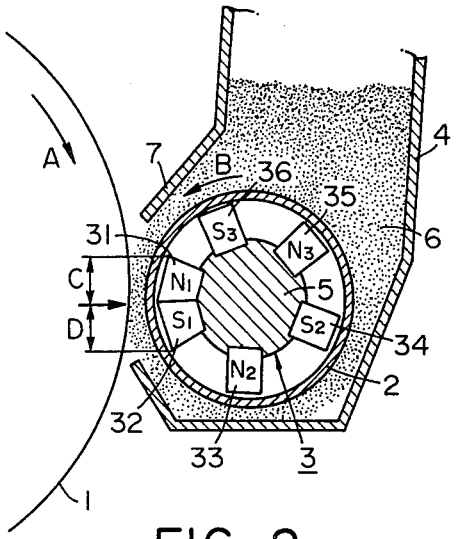
FIG. 2 is the cross sectional view of the invented developing apparatus applied to the magnet brush development.

FIG. 2 shows the cross sectional view of the invented development apparatus applied to the case of magnet brush development. The items having the same numbers as FIG. 1 have the same configuration. In the drawing the roller 5 of the magnetic field generating means 3 is fixed to the developing apparatus box 4. Magnets 31 to 36 are established on the outside. The sleeve 2 is rotatable on the outer circumference of the magnets in the direction of the arrow mark B which is in forward direction with the light sensitive drum 1. The toner 6 erects its ears on the sleeve caused by the magnetic force of the magnetic pole N1 and develops the electrostatic image by rubbing the electrostatic image on the light sensitive drum 1 at the C area (developing area) of the light sensitive drum.

By making the intensity of the magnetic field of the magnetic pole S1 stronger than that of the magnetic pole N, the fog removing after development is made by the strong magnetic force in quite the same manner as the case of the above-mentioned jumping development. In other words, this invention is to develop the electrostatic image completely by the magnetic brush caused by the ear-erected toner generated by the magnetic field of the magnet pole N1 when the electrostatic image passed through the C area (in this case it is allowed to generate fogging) and then remove the fog by the strong magnetic field of the magnetic pole S1 when the image passed through the D area.

Although in this case the toner of the picture area cannot be peeled once it has stuck due to the sticking force such as the coulomb force, since in the no-picture area the sticking force is weak compared with the picture area some toner that has stuck to this section is made to jump toward the sleeve.

One portion of the developing apparatus box 4 plays the role of developing agent regulating member 7. It is preferable in performing good development to apply a developing bias also to the apparatus of FIG. 2.

Figure 3:
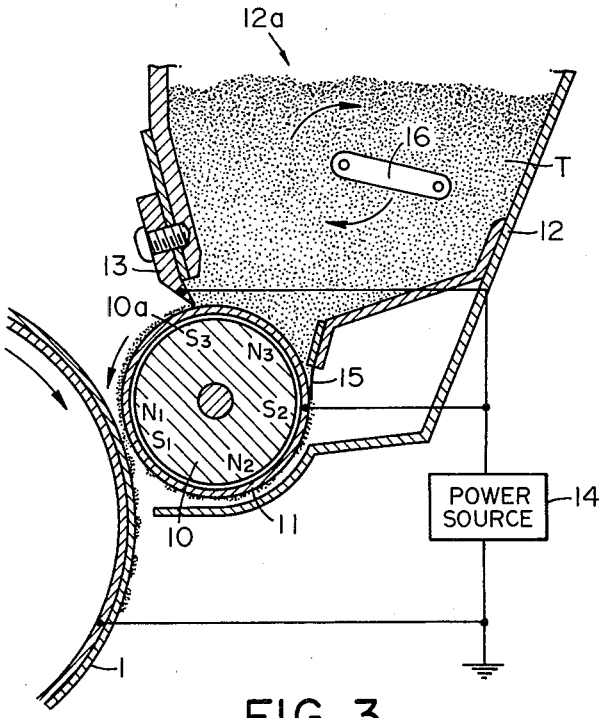
FIG. 3 is the cross sectional view of the other embodiment of this invention applied to the jumping developing system.

FIG. 3 is the cross sectional view of another embodiment of this invention applied to the jumping developing system.

In the embodiment shown in FIG. 3, the multipolar permanent magnet roll 10 is used as the magnetic field generating means and the multipolar permanent magnet roll 10 is fixed and used to rotate the non-magnetic cylinder 11, which is the toner supporter, in the same direction shown by the arrow as the light sensitive drum 1 with proximity surfaces. By the rotation of the cylinder 11 the single constituent insulating strong magnetic toner sent from the hopper section 12*a* of the developing apparatus box 12 is applied to the surface of the non-magnetic cylinder.

In this case, the charging system is so selected that due to the friction between the cylinder surface and the toner grains, the toner grains and given electric charges reverse in polarity to the electric change of the electrostatic image. In this embodiment, aluminum material is used as the non-magnetic cylinder 11 which is small to cylinder form as shown in the drawing. As the multipolar permanent magnet roll 10 was used the magnet roll on which the developing magnetic pole N1, fogging magnetic pole S1, carrier magnetic poles N2, S2, N3, and the cut magnetic pole S3 are arranged in this order.

Further, the iron doctor blade 13 is arranged in proximity to the cylinder surface 150μ to 500μ in distance. The blade 13 is a thin plate having the direction of the generating line of the non-magnetic cylinder surface as its longitudinal direction as shown by one example shown in FIG. 3, and by setting the blade 13 in a position opposite to the position of the magnetic pole 10*a* (the pole S3 in the drawing) one of the magnetic poles of the multipolar permanent magnet roll 10, the toner layer is controlled to be thin (30μ to 300μ, preferably 30μ to 200μ) and uniform and to be thinner than the width of the slit between the toner layer surface and the light sensitive drum.

Adjust the cylinder speed so that the surface layer speed of the toner layer and preferably the inner speed of the toner layer is practically the same as the speed of the electrostatic image holding surface or close to this speed. Other magnetic materials than iron can be used as the doctor blade 13 and magnet can also be used. In the drawing, 14 is the power supply which applies the developing bias voltage across the non-magnetic cylinder 11 and the light sensitive drum 1. Although it is allowed to use the non-magnetic cylinder 11 grounded, a very good development is attained by developing with a DC or AC bias applied from the power supply 14 to it (cylinder).

As for the AC bias although a detailed description is contained in U.S. patent application Ser. Nos. 58,434 and 58,435, offered by this assignee, in the above-mentioned embodiment shown in FIG. 3 a good fog-free positive picture with favorable reproduction of medium tone was obtained by forming a latent image having +500 V picture area and OV no-picture area and applying an AC waveform voltage having peak values ranging from +900 V to approx. −700 V, which was formed by superimposing an AC of 100∼1500 Hz, for example, 400 Hz onto the DC component.

The same effect is obtained by other alternating voltages and as the AC having distorted waveforms or square waves. When applying this AC bias, it is a good thing to position the non-magnetic cylinder 100 to 500μ, preferably 200 to 300μ, apart at the developing area from the surface of the light sensitive drum. In this case, make the toner layer thinner than the above-mentioned interval, for example to 30 to 300μ, preferably to 30 to 200μ as mentioned above, to form an air gap between the toner layer surface and the electrostatic image holding surface. When the alternating electric field is directed toward the gap, the toner travels back and forth in the gap, and proper development is made. The toner is desired to have insulating properly viewed from the point of development and transcription which follows.

The doctor blade 13 is brought to the same potential as the non-magnetic cylinder 11, to prevent non-uniform coating of the toner.

The item 15 is the scrape which is used to remove the remaining toner from the non-magnetic cylinder and 15 is the stirring member which prevents the toner in the hopper from bridging.

As the magnetic toner, the toner, 5 to 30μ in average grain diameters, formed by well-known method by mixing, as an example, 75 parts of polystylene, 15 parts of magnetite, 3 parts of charge controlling agent, and 6 parts of carbon. It is of course possible for other well-known magnetic toners having the same grain diameter distribution and containing 15 wt percent on more and less than 50 wt percent of magnetite.

The reasons for making the average grain diameter of the toner and its magnetite content stay in the above-mentioned ranges are as follows.

When the average grain diameter of the toner grains becomes below 5μ the toner sticks strongly to the non-magnetic cylinder surface and becomes hard to jump from the cylinder surface, resulting in an incomplete development. Moreover, reduction in development density due to incomplete shifting caused the formation of fine toner gain layer on the surface of the non-magnetic cylinder which interferes the contact changing between the near toner and the cylinder surface.

On the other hand, when the average grain diameter of the toner grains exceeds 30μ the drawback of coarse picture appears.

When the magnetite content is below 15 wt%, toner gains having smaller magnetite power content are formed when powdering the toner to manufacture toner gains. When these gains small in magnetite power content is mixed with the developing agent, a developing agent easy to condensate and poor in fluidity is obtained. As a result, it is hard to change the gains uniformly, easy to generate fog and the magnetic force to be drawn back by the magnet becomes weak, fog is generated and good picture quality is hard to obtain and magnetic carrying becomes hard. On the other hand when the content exceeds 50%, undesirable results such as reduction in the resin constituent, degradation of fixing property are obtained and the picture quality becomes coarse. When development was made by using the developing apparatus meeting the above-mentioned requirements and making the intensity of the magnetic field of the developing magnetic pole N, 650 gauss and the intensity of the magnetic field of de-fogging magnetic pole S1 850 gauss, a good quality developed image high in picture density and free of fog was obtained.

As has been described so far, since this invention has the construction in which the electrostatic image area on the electrostatic image holding body is passed successively near the generating means of magnetic fields different to each other in polarity adjacent in said sleeve which faces said electrostatic image holding body, it is possible after ending a complete development in the neighborhood of development processing section to remove the fog generated by the development and the electrostatic image can be developed into a picture of good quality high in picture density and free of fog.

Moreover this invention is useful since both the development processing and de-fogging can be made by a very simple configuration.

What I claim is:

1. A developing apparatus for developing a latent image by applying a one component magnetic developing agent to the latent image provided on a latent image bearing member, comprising:

a rotatable developing agent carrying member of non-magnetic material for carrying on its surface the one component magnetic developing agent, means for supplying the developing agent to the developing agent bearing member, magnetic field generating means disposed within said developing agent carrying member, said magnetic field generating means having a developing magnetic pole for effecting development in a developing zone and a magnetic pole, having a polarity opposite to that of said developing magnetic pole, for removing fog by transferring the developing agent that has been deposited on the non-image area of the latent image bearing member back to said developing agent carrying body, means for defining a gap between the surface of the developing agent layer on said developing agent carrying member surface and the latent image bearing member across which the developing agent flies to develop the latent image, means for applying an alternating developing bias electric field across said gap, and regulating means for regulating the quantity of developing agent on the surface of said developing agent carrying member to regulate the thickness of the developing agent layer to be smaller than said gap.

2. A developing apparatus as set forth in claim 1 in which the intensity of the magnetic field of the magnetic pole for removing the fog is stronger than the intensity of the magnetic field of the magnetic pole for development.

3. A developing apparatus as set forth in claim 1 or 2 in which the intensity of the magnetic field of the developing magnetic pole is 500 to 700 gauss.

4. A developing apparatus as set forth in claim 1, 2, or 3 in which the intensity of the magnetic field of the magnetic pole for fog removal is 600 to 1000 gauss.

5. A developing apparatus as set forth in claim 1 in which said regulated means is a magnetic blade.

6. A developing apparatus as set forth in claim 5 in which the magnetic field generating means has a magnetic pole at a position opposite to said magnetic blade.

7. A developing apparatus for developing an electrostatic image by applying a one component magnetic toner to the electrostatic image on an image bearing member, comprising:

a rotatable non-magnetic sleeve, means for supplying the magnetic toner to said sleeve, magnetic field generating means disposed within said sleeve, said magnetic field generating means having a developing magnetic pole and an adjacent magnetic pole of greater intensity, having a polarity opposite to that of said developing magnetic pole, positioned for removing fog, means for defining a gap between the surface of the toner layer on said sleeve and the image bearing member across which the toner flies to develop the electrostatic image, means for applying an alternating developing bias electric field across said gap, and a regulating blade for regulating the quantity of magnetic toner on the surface of said sleeve to regulate the thickness of the toner layer to be smaller than said gap.

* * * * *